US010780454B2

(12) United States Patent
Summons et al.

(10) Patent No.: US 10,780,454 B2
(45) Date of Patent: Sep. 22, 2020

(54) SEALANT APPLICATOR AND METHODS OF USE

(71) Applicant: Sashco, Inc., Brighton, CO (US)

(72) Inventors: Wayne L. Summons, Thornton, CO (US); Elliot P. Summons, Littleton, CO (US); Kurt Van Ulmer, Golden, CO (US); Scott Tunney, Fort Collins, CO (US)

(73) Assignee: SASHCO, INC., Brighton, CO (US)

( * ) Notice: Subject to any disclaimer, the term of this patent is extended or adjusted under 35 U.S.C. 154(b) by 0 days.

(21) Appl. No.: 15/424,657

(22) Filed: Feb. 3, 2017

(65) Prior Publication Data

US 2017/0225190 A1 Aug. 10, 2017

Related U.S. Application Data

(60) Provisional application No. 62/291,643, filed on Feb. 5, 2016.

(51) Int. Cl.
*B05C 17/005* (2006.01)

(52) U.S. Cl.
CPC ..... *B05C 17/00516* (2013.01)

(58) Field of Classification Search
CPC ..... B05C 17/00516; B05C 17/00506
USPC ..... 222/566
See application file for complete search history.

(56) References Cited

U.S. PATENT DOCUMENTS 708,709 A * 9/1902 Hennebery ..... A46B 11/0041 15/236.01
1,038,180 A * 9/1912 Moreland ..... B05C 17/00516 401/179
2,065,243 A * 12/1936 Perkins ..... B65D 47/2031 222/490
2,716,251 A * 8/1955 Pearce ..... A23G 3/2023 401/139
2,754,033 A * 7/1956 Etter ..... B41L 27/02 222/326
2,804,767 A * 9/1957 Schoen ..... B05C 17/00516 111/7.1
2,888,695 A * 6/1959 Anderson ..... A45D 40/26 401/208
2,988,775 A * 6/1961 Painter ..... B05C 17/005 401/261
3,087,654 A * 4/1963 Moore ..... E04F 21/04 222/105
3,090,071 A * 5/1963 Le Brooy ..... A47G 19/183 222/107
3,255,937 A * 6/1966 Jarrett ..... B65D 35/08 222/480

(Continued)

*Primary Examiner* — Patrick M. Buechner
*Assistant Examiner* — Michael J. Melaragno
(74) *Attorney, Agent, or Firm* — Perkins Coie LLP

(57) ABSTRACT

A sealant applicator nozzle, of the present technology, has a fan-shaped profile, with a broad concave arc that defines a distal end of the nozzle and provides the nozzle with a tooling edge. The concave tooling edge, along with the outlet orifice, and two surface-contact edges are positioned to equidistantly straddle a lap joint to be sealed when in operation. In methods of using the nozzle, a wide ribbon of sealant is applied in a smoothly arched geometry, forming a segment of a circle, over a lap joint so that the thickest part of the arch is centered directly on the edge of the overlapping material that forms the lap joint.

19 Claims, 6 Drawing Sheets

(56) References Cited

U.S. PATENT DOCUMENTS 4,211,501 A * 7/1980 Pedroso ..... B05C 17/00516 15/235.7
4,331,269 A * 5/1982 Holman ..... B65D 83/306 222/402.21
4,380,425 A * 4/1983 Edelman ..... B05C 17/00516 401/265
4,546,906 A * 10/1985 Vadnais ..... B05C 17/005 222/502
4,570,834 A * 2/1986 Ward ..... B05C 17/00516 222/566
4,872,778 A * 10/1989 Longo ..... B05C 17/00516 401/193
4,887,924 A * 12/1989 Green ..... A45D 40/26 222/106
5,000,361 A * 3/1991 Briddell ..... B05C 17/00516 222/575
5,017,113 A * 5/1991 Heaton ..... B05C 17/00516 222/327
5,046,877 A * 9/1991 Longo ..... B05C 17/00516 222/566
5,588,560 A * 12/1996 Benedict ..... B65D 35/38 222/106
5,695,788 A * 12/1997 Woods ..... B05C 17/00516 15/235.7
5,749,498 A * 5/1998 Lavoie ..... B05C 17/00516 222/192
5,890,630 A * 4/1999 Lobdell ..... B65D 35/36 222/192
5,902,060 A * 5/1999 Rodriguez ..... A45D 26/0014 220/784
D413,236 S * 8/1999 De Montigny ..... D23/200
6,299,034 B1 * 10/2001 Tancheff ..... B05C 17/00516 222/502
6,340,103 B1 * 1/2002 Scheindel ..... B65D 83/201 222/402.15
6,422,777 B1 * 7/2002 Landrau ..... B05C 17/00516 222/566
6,450,723 B1 * 9/2002 Lithgow ..... B05C 17/00516 222/566
6,497,334 B1 * 12/2002 Scheindel ..... B65D 83/30 215/390
6,520,702 B2 * 2/2003 Heusser ..... B05C 17/00516 222/566
6,935,541 B1 * 8/2005 Campbell ..... B05C 17/015 137/557
6,981,611 B2 * 1/2006 Carruth ..... B05C 17/00516 222/1
7,222,758 B1 * 5/2007 Scheindel ..... B65D 83/46 222/402.13
7,325,995 B2 * 2/2008 Keller ..... A61B 17/00491 222/566
7,695,210 B1 * 4/2010 Martinez ..... B05C 17/00503 401/193
8,016,507 B2 * 9/2011 Wright ..... A45D 34/00 401/266
8,893,644 B2 * 11/2014 Nakamura ..... B05B 1/044 118/24
9,072,570 B2 * 7/2015 Maurat ..... A61C 5/062
2003/0192910 A1 * 10/2003 Liljeqvist ..... B65D 83/201 222/108
2004/0149204 A1 * 8/2004 Park ..... B05C 17/00516 118/200
2005/0025560 A1 * 2/2005 Liberatore ..... B05C 17/00506 401/266
2005/0135869 A1 * 6/2005 Liberatore ..... B05C 17/00506 401/266
2007/0025807 A1 * 2/2007 Liberatore ..... B05C 17/00506 401/266
2007/0127978 A1 * 6/2007 Park ..... A46B 3/04 401/193
2009/0045230 A1 * 2/2009 Liberatore ..... B05C 17/00503 222/566
2010/0181349 A1 * 7/2010 Carvalho ..... B65D 25/48 222/566
2010/0239705 A1 * 9/2010 Jorstad ..... B05C 17/00506 425/461
2012/0043346 A1 * 2/2012 Nentwick ..... A61B 17/00491 222/1
2012/0091172 A1 * 4/2012 Maier ..... B05C 17/00503 222/566
2012/0168469 A1 * 7/2012 Schwarze ..... B05C 17/00503 222/568
2013/0306674 A1 * 11/2013 Read ..... A23G 3/28 222/94
2015/0024131 A1 * 1/2015 Evans ..... B05D 5/005 427/207.1
2016/0114350 A1 * 4/2016 Brodbeck ..... B05C 17/00516 427/421.1
2016/0167081 A1 * 6/2016 Kim ..... B05C 17/00503 222/566
2016/0214121 A1 * 7/2016 Ullett ..... B05C 17/00516

* cited by examiner

SEALANT APPLICATOR AND METHODS OF USE

CROSS-REFERENCE TO RELATED APPLICATIONS

The present application is a non-provisional of U.S. Provisional Patent Application Ser. No. 62/291,643, titled "SEALANT APPLICATOR AND METHODS OF USE", filed Feb. 5, 2016, which is incorporated herein as if set out in full.

BACKGROUND

The present technology relates to systems and methods of sealing against leaks of water and air, and the intrusion of insects, through specific types of joints that occur primarily in the out-most surface envelopes of buildings, whether on roofs or walls, and whether of residential, commercial or industrial architecture. One current method of sealing what are commonly referred to as lap joints (such as where metal flashings overlay other roofing or wall components to form a dynamic joint) consists primarily of taking bulk, pasty sealants (frequently based on asphaltic chemicals) out of 1-gallon cans or 5-gallon pails with a trowel and then smearing the sealant onto the area of the targeted lap joint in an attempt to effect a reliable, leak-proof seal. This bulk application and smearing process is inherently an imprecise method of sealant application and leads to a variety of problems, especially for inexperienced people, including: inconsistent thicknesses of sealant from location to location (with some sealant typically being smeared too thinly to avoid failure), wasted sealant (by being applied too widely and with some sealant being applied excessively thick), wasted time, wasted labor costs, messy application, high cleanup costs, ugly appearance, and frequent sealant failure. Some lap joints, illustrating another common sealing method, are currently sealed with forms of pressure-sensitive tapes, such as the high-tack tapes routinely applied to the lap joints formed where window nailing fins overlap the OSB or plywood sheathing that typically comprises the exterior wall underlayment in common residential and light commercial construction; and such tapes do experience appreciable levels of failure, particularly when used in cold weather, due to poor adhesion of such tapes in low-temperature conditions. In addition and more recently, aerosol-spray-applied rubberized sealant-coatings have been touted as being an effective and efficient means of sealing such lap joints. However, such spray-on products have been widely reported to have experienced many failures and complaints from users due to not being able to build sufficient sealant thickness in one or even two applications to reliably work; or requiring the applicator to apply many, many coats of spray-on product in order to build sufficient film thickness to be reliably effective. The present technology overcomes the aforementioned drawbacks that current sealing methods suffer from delivering the highest possible quality (including an attractive appearance), and doing so while saving a great deal of time, effort, clean-up, and material.

While many types of dispensing nozzles for caulks and sealants are well known in the architectural construction and repair trades, including fan nozzles that produce wide ribbon beads of sealant, none of them have ever delivered a satisfactory performance. Conventional fan nozzles that have been known in the trade, for example, have typically dispensed a wide flat bead of sealant, i.e. a ribbon bead, in a roughly rectangular cross-sectional profile, with the wide ribbon bead of sealant being merely deposited in a "passive" manner as it exits the nozzle from, typically, a caulking cartridge onto a surface without any appreciable tooling-force being automatically applied by the nozzle to the pasty, semi-fluid sealant during application. Such a tooling-force is needed to aggressively drive the semi-fluid sealant into the substrates being sealed in order to achieve good surface wetting and adhesion because semi-fluid sealants do not readily flow and wet surfaces on their own (like thin liquids do). When using such conventional fan nozzles, which are well represented by the fan nozzle assortments offered by such companies as Albion Engineering, for example, it is a best practice to then employ follow-up tooling, say with a trowel or putty knife, to forcefully push the semi-fluid ribbon of sealant into the substrates to be sealed for the best possible wetting and adhesion. When such secondary tooling is then done, it wastes time and increases labor cost, and there is always a tendency to inadvertently thin out the thickness of the sealant in some areas excessively, which can then lead to sealant failure, resulting in building leaks. Secondary tooling also means that the tools used to force the sealant into intimate contact with the surfaces being sealed need to be cleaned, taking more time and labor.

Other sealant application nozzles have also been known in other trades, such as the aerospace industry, but all such previous sealant nozzles have been ill-designed and unsuitable for use in sealing lap joints found on typical architectural construction. For example, nozzles sold under the Semco tradename, such as models #425 and #429, have proven unacceptable for sealing architectural lap joints. For example, such nozzles are not wide enough to cover lap joints effectively. They do not have angled orifice surface, which causes a lack of tooling force, which requires tooling labor and time. Furthermore, their rectangular orifice wastes material.

DRAWINGS

Non-limiting and non-exhaustive embodiments of the present invention, including the preferred embodiment, are described with reference to the following figures, wherein like reference numerals refer to like parts throughout the various views unless otherwise specified.

SUMMARY

Figure 1:
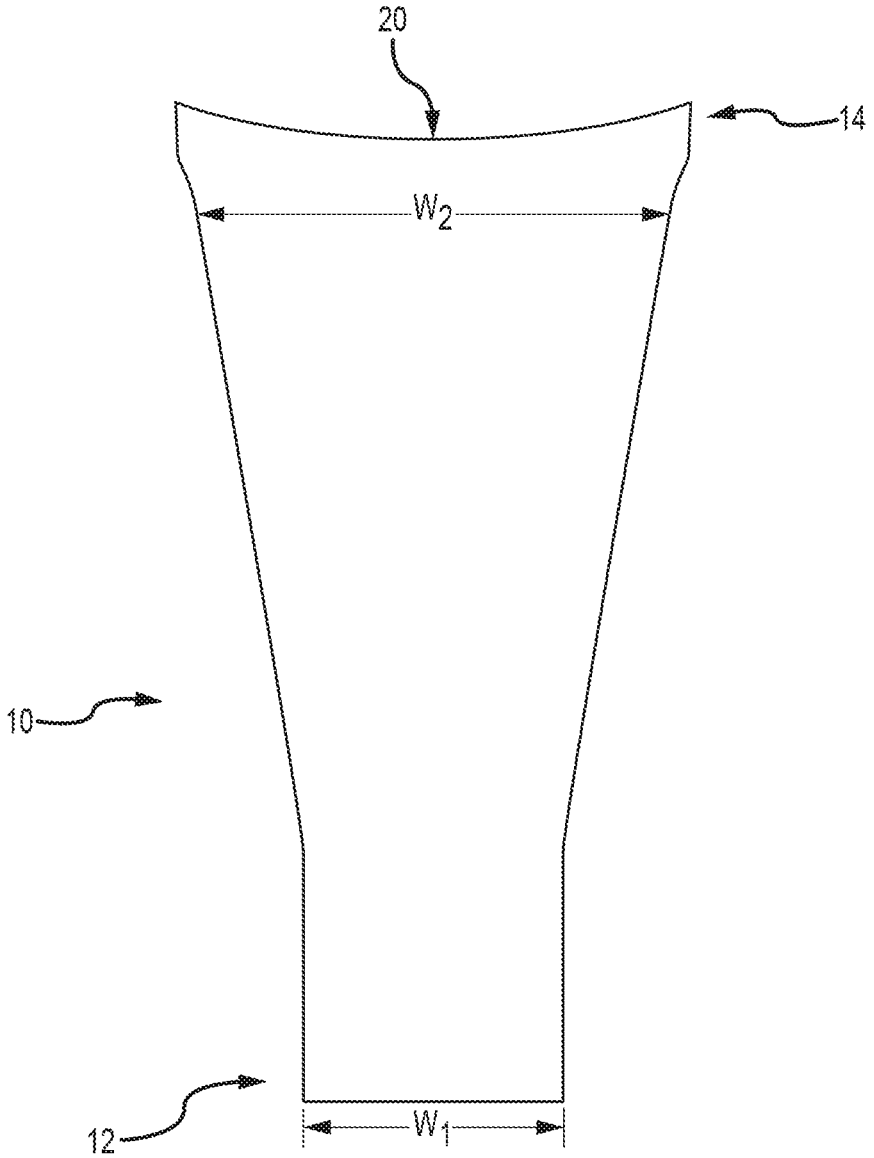
FIG. 1 depicts a top view of one embodiment of a sealant applicator nozzle of the present technology.

This Summary is provided to introduce a selection of concepts in a simplified form that are further described below in the Detailed Description. This Summary, and the foregoing Background, is not intended to identify key aspects or essential aspects of the claimed subject matter. Moreover, this Summary is not intended for use as an aid in determining the scope of the claimed subject matter.

The present disclosure provides a sealant applicator nozzle and methods of using the same. In various embodiments, the sealant applicator nozzle includes an inlet end portion, having a first width, and an opposite outlet end portion, having a second width that is wider than the first width. The outlet end portion has a concave contact surface that extends across the second width and surrounds an outlet orifice. In some embodiments, the contact surface is disposed at a contact surface angle with respect to a longitudinal plane that passes through the first width and the second width. In particular embodiments, the contact surface angle is between 30 degrees to 60 degrees. In other embodiments, the contact surface angle is between 40 degrees to 50 degrees.

Embodiments of the sealant applicator nozzle provide the contact surface with a concave tooling edge positioned at a distal-most end of the sealant applicator nozzle to tool the bead of sealant as it is dispensed. The outlet end portion has a cross-sectional shape that helps to define the bead of sealant dispensed by the sealant applicator nozzle. In some embodiments, the cross-sectional shape of the outlet end portion is elliptical, biconvex, or plano-convex.

Methods of applying a sealant to a surface using the sealant applicator nozzle of the present technology are provided herein. In various embodiments, the method includes positioning a concave contact surface of a sealant applicator nozzle closely adjacent the surface, wherein the sealant applicator nozzle includes an inlet end portion and an opposite outlet end portion that are fluidly coupled with one another by a nozzle interior that extends along a length of the sealant applicator nozzle. In some embodiments the inlet end portion has a first width and the outlet end portion has a second width that is wider than the first width. The sealant is dispensed from an outlet orifice in the concave contact surface onto the surface. In various embodiments the concave contact surface is disposed at an angle with respect to a longitudinal plane that passes through the first width and the second width.

In various embodiments, the dispensing step includes shaping the sealant into a ribbon bead, having an arched geometry that tapers at opposite edges of the ribbon bead. The shaping is induced by a tooling edge of the contact surface as the sealant is dispensed from the sealant applicator nozzle. In various embodiments, the arched geometry is defined by a cross-sectional shape of the outlet end portion. In particular embodiments, the cross-sectional shape of the outlet end portion is elliptical, biconvex, or plano-convex. In certain methods, the surface receiving the sealant is a lap joint and the arched geometry is centered on the lap joint. The sealant can be dispensed by manually applying pressure to a sealant container or from a pressurized sealant container.

These and other aspects of the present system and method will be apparent after consideration of the Detailed Description and Figures herein. It is to be understood, however, that the scope of the invention shall be determined by the claims as issued and not by whether given subject matter addresses any or all issues noted in the Background or includes any features or aspects recited in this Summary.

DETAILED DESCRIPTION

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense.

FIGS. 1-6 depict embodiments of a sealant applicator nozzle 10 and methods of using the same. It is contemplated that particular methods of employing the present technology may make it desirable to slightly alter the configuration of the depicted embodiments. Such modifications and varying embodiments are encompassed by the present technology. In particular methods of manufacture, the sealant applicator nozzle 10 may be fabricated by injection molding methods with various known plastics or may be manufactured using other known methods and with other materials, including various metals.

With reference to FIGS. 1-5, embodiments of the sealant applicator nozzle 10 have an inlet end portion 12 and an opposite, outlet end portion 14. It is contemplated that the inlet end portion 12 will be shaped to engage an outlet end of a sealant container, such as a tube, caulking cartridge, pressurized canister, or other known sealant container 22. Accordingly, some embodiments of the inlet end portion 12 have a circular cross section and include mating threads, either internally or externally positioned on the inlet end portion 12. This allows the sealant applicator nozzle 10 to be easily, and removably, secured with the sealant container 22. In other embodiments, a bayonet mount, either internally or externally situated on the inlet end portion 12, is used to secure the sealant applicator nozzle 10 with the sealant container 22. It is contemplated, however, that other mechanical fastening structures may be used in place of mating threads or a bayonet mount, depending on the manufacturing or application needs presented. Regardless of the mechanism employed, the sealant applicator nozzle 10 should be solidly attached, in a leak-free manner, to one of a variety of sealant containers 22.

Figure 2:
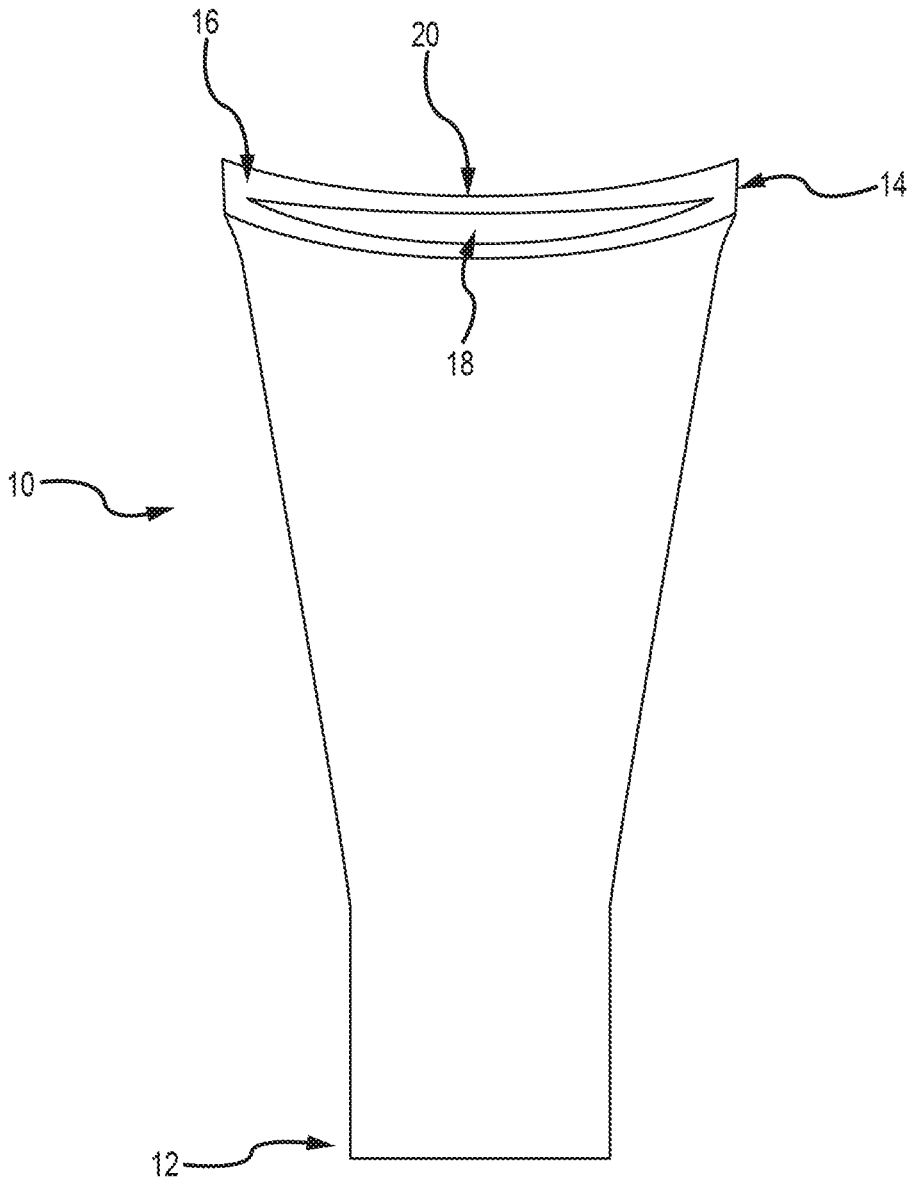
FIG. 2 depicts a bottom view of the sealant applicator nozzle of FIG. 1.

With reference to FIGS. 1 and 2, the sealant applicator nozzle 10 may be provided with a generally fan-shaped profile, extending from the inlet end portion 12, having a first width, toward the outlet end portion 14, having a second width. As depicted, the first width is more narrow than the second width. It is contemplated that the first width may correlate to an approximate width of an outlet end portion of a sealant container 22. It is further contemplated that the second width may vary according to a desired width of a bead 24 of sealant that is dispensed from the sealant applicator nozzle 10. In various embodiments the second width is 1.25 inches. In some embodiments, the second width is 0.875 inches.

Figure 3:
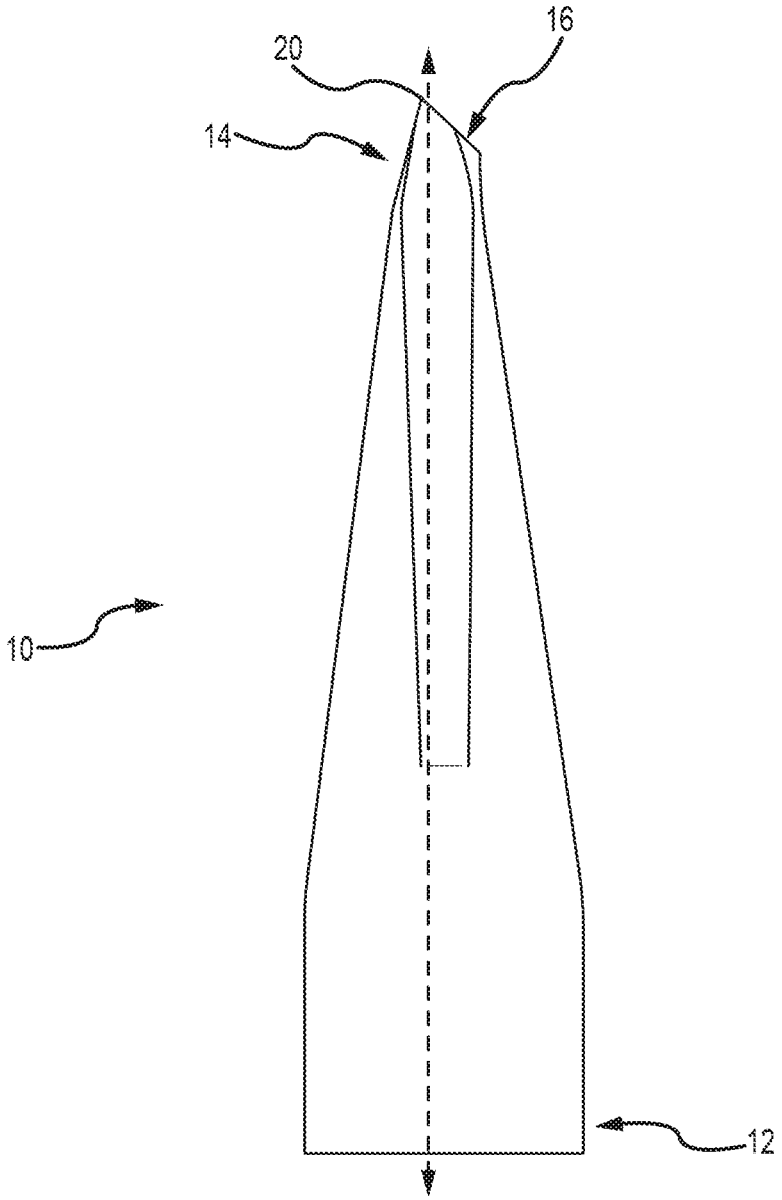
FIG. 3 depicts a side view of the sealant applicator nozzle of FIG. 1.

With reference to FIG. 3, a contact surface 16 of the outlet end portion 14 is shaped to straddle the lap joint 26 to be sealed so that it will make contact with the surfaces that define the lap joint 26. In at least one embodiment, the contact surface 16 is disposed at a contact surface angle with regard to a longitudinal plane that passes through the first width and the second width of the sealant applicator 10. In a particular embodiment, the contact surface 16 is disposed at a 45 degree angle with respect to the longitudinal plane. The angled contact surface 16 allows for the sealant applicator nozzle 10 to rest firmly on a surface to be sealed, while providing for a drag angle that lets the sealant applicator nozzle 10 readily glide over minor obstructions that are frequently present in typical roof and wall surfaces. In this manner, the sealant applicator nozzle 10 avoids hang-ups during sealant application. Other angle orientations may be employed if unusual applications or conditions are presented. In various embodiments, the contact surface 16 may be disposed at an angle ranging from 30 degrees to 60 degrees, while other embodiments may include a contact surface 16 disposed at an angle ranging from 40 degrees to 50 degrees.

Figure 4:
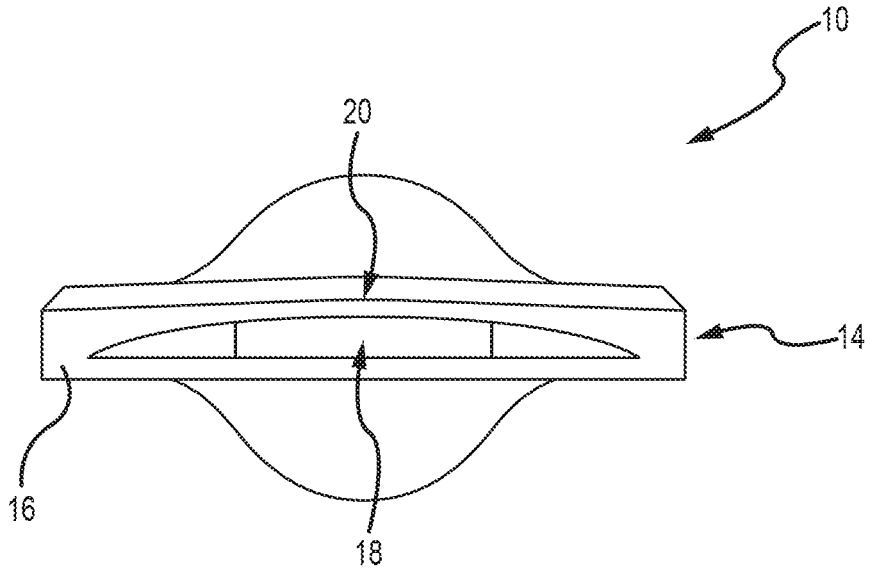
FIG. 4 depicts an outlet end view of the sealant applicator nozzle of FIG. 1.
Figure 5:
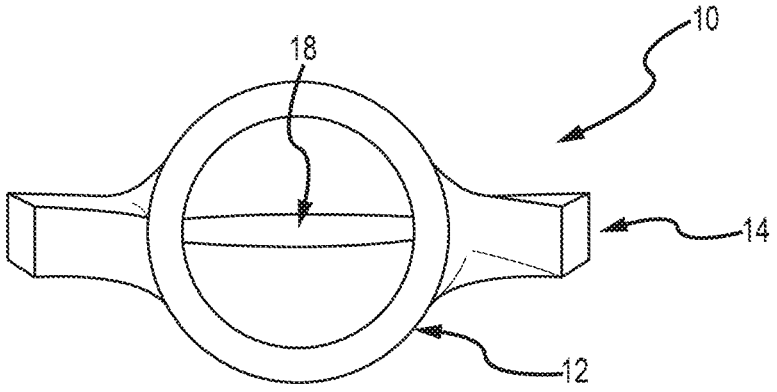
FIG. 5 depicts an inlet end view of the sealant applicator nozzle of FIG. 1.
Figure 6:
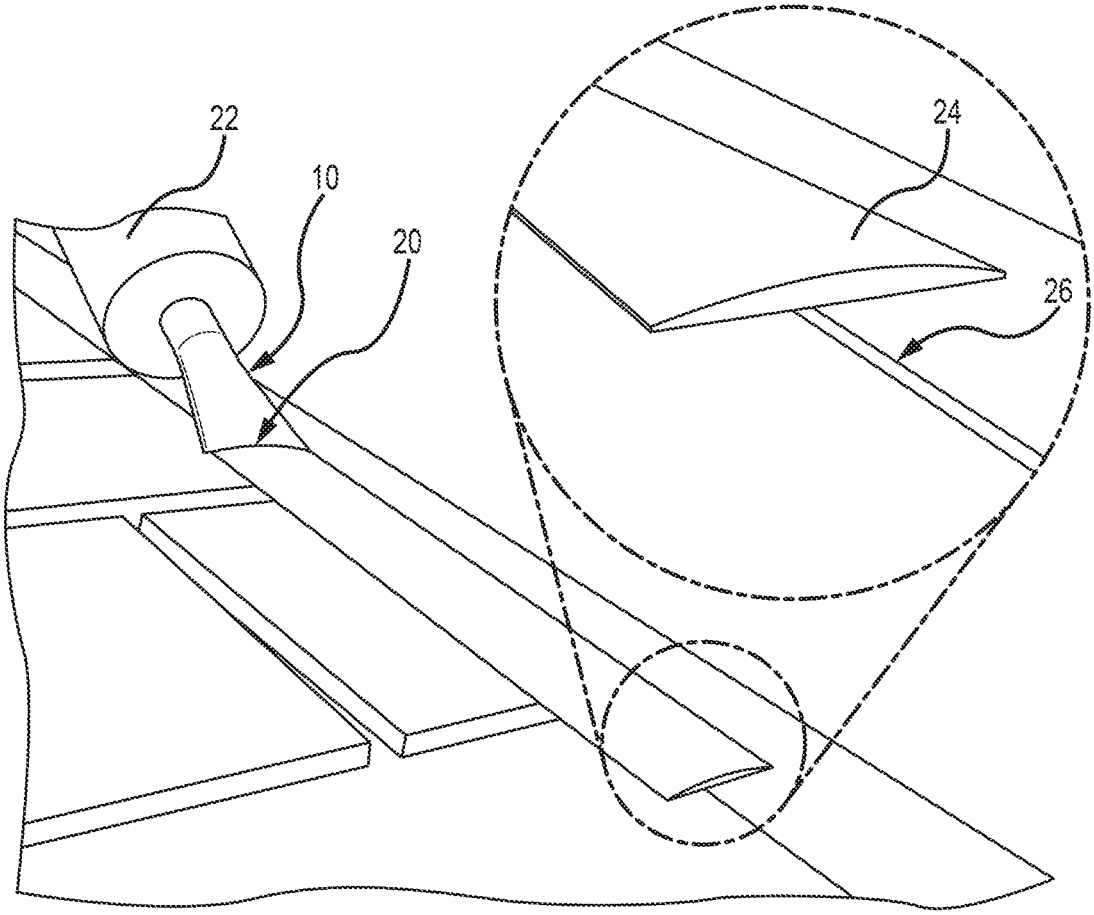
FIG. 6 depicts one manner in which an embodiment of the sealant applicator nozzle of the present technology can be used to seal a lap joint of a structure.

With reference to FIGS. 4 and 5, embodiments of the sealant applicator nozzle 10 have an internal, cross-sectional geometry that is cylindrical at the inlet end portion 12 and tapers to a narrow thickness, adjacent the outlet end portion 14. Simultaneously, the width of the interior of the sealant applicator nozzle 10 broadens in a fan shape from the inlet end portion 12 toward the outlet end portion 14, as depicted in FIGS. 1 and 2. In some such embodiments, the outlet end portion 14 of the sealant applicator nozzle 10 has a cross-sectional profile similar to an ellipse. In other embodiments, the sealant applicator nozzle 10 has a cross-sectional profile similar to a biconvex lens, with opposite arcuate, convex sides and truncated ends. In still other embodiments, sealant applicator nozzle 10 has a cross-sectional profile similar to a plano-convex lens, wherein one side is convex while the opposing side is flat or nearly flat, such as depicted in FIG. 4.

With reference to FIGS. 1 and 2, various embodiments of the the contact surface 16 of the output end portion 14 are concave, extending rearwardly toward the inlet end portion 12. The concave shape is formed as if the contact surface 16 were intersected by the exterior surface of a cylinder. This inferred angled intersection leads to the formation of an outlet orifice 18 that is located slightly behind a curved tooling edge 20 of the contact surface. With reference to FIGS. 2 and 3, the angle at which the contact surface 16 is disposed with respect to the longitudinal plane of the sealant applicator nozzle 10, positions the tooling edge 20 at the distal-most end point of the sealant applicator nozzle 10. Such an off-set position leads to the creation of a region of relatively high pressure being applied to the sealant as it exits the outlet orifice 18, as the sealant applicator nozzle 10 is dragged along a length of a lap joint 26. This forces the sealant leaving the outlet orifice 18 into the surfaces to be sealed, automatically, ensuring good wetting of the substrates by the sealant; thereby achieving excellent adhesion. The curved geometrical sections of the outlet orifice 18 and the tooling edge 20 also work in concert with one another to limit excess material from exiting the output end portion 14 at the sides of the output orifice 18 during application and being wasted, as would be the case if the cross-sectional profile of the outlet orifice 18 were rectangular. In particular embodiments, a cap (not depicted) can be provided to removably cover the outlet end portion 14 and/or fill the outlet orifice 18. In this manner, the sealant within the sealant applicator nozzle 10 will not set within the nozzle between applications.

In at least one method of use, the sealant applicator nozzle 10 of the present technology applies a wide ribbon of sealant in a smoothly arched geometry (forming a segment of a circle) over a lap joint 26 so that the thickest part of the arch is centered directly on the edge of the overlapping material that forms the lap joint 26. In so doing, as inevitable thermal expansion/contraction occurs at the lap joint 26, it is assured that ample sealant material is present to accommodate such movement without cohesively failing, which can occur if the sealant thickness is too thin over the lap joint 26. In particular embodiments, some ribbon beads 24 have a width of 1.25 inches and a height of 0.125 inches. In other embodiments, the ribbon beads have a width of 0.875 inches and have a height of 0.0625 inches. Other dimensions are contemplated, based on the needs presented by the sealing operation. In addition, the thickness of the arched ribbon of sealant smoothly declines away from the center of the ribbon bead 24 on both sides until the thickness becomes essentially zero at the two edges of the ribbon bead 24, which greatly reduces the amount of sealant that would otherwise be applied. In particular embodiments, the sealant savings can be at least 30%, depending on the radius of curvature chosen, when compared with a conventional ribbon bead, having a rectangular bead profile.

The sealant applicator nozzle 10 of the present technology automatically tools a ribbon bead 24 of sealant as it is applied to ensure that the semi-fluid sealant is forcefully driven into the substrates that are being sealed. This automatic tooling-force reliably and consistently drives the semi-fluid sealant into contact with the substrates being sealed so that excellent surface wetting by the sealant occurs, which increases adhesion. Laboratory experiments have consistently demonstrated that the sealant applicator nozzle 10 of the present technology drives sealants into the substrates being sealed deeper than conventional nozzles. This testing was done over new and well-stretched common screen-door screens. Conventional fan nozzles merely laid a ribbon bead 24 of sealant on the surface of the screen in a passive manner, with little or no sealant being driven through the screen holes. The sealant applicator nozzle 10, however, vigorously pushed a large volume of sealant through the square holes of the screen while the sealant applicator nozzle 10 was smoothly drawn over the screen surface. The design allows the sealant applicator nozzle 10 to be drawn over a lap joint 26 at about a 45 degree angle (in one embodiment), allowing the applicator to easily glide, with minimal "catching", over irregularities that are very frequently present on roof surfaces and wall substrates.

The geometry of the sealant applicator nozzle 10 ensures that beads 24 of sealant can be applied in a precise and consistent manner. The arch-shaped and automatically well-tooled bead 24 of sealant is applied in one pass. Accordingly, no secondary tooling is needed (like with a putty knife or trowel) and there is no need for clean-up of any kind. Compared to other methods, like spray-on, thin liquid sealants, which typically require several successive applications over lap joints, the present technology saves considerable time and labor, which saves overall costs. Moreover, the bead 24 of sealant that is placed with the sealant applicator nozzle 10, of the present technology, has an attractive aesthetic appearance, especially when clear sealants are used, which is more appealing than beads produced by previously known methods.

Various embodiments of the sealant applicator nozzle 10 can effectively be used with many caulk-gun sealants in cold weather to seal the edges of window nailing fins (where the fins overlap OSB or plywood wall sheathing), replacing pressure-sensitive tapes that are failure-prone in low temperatures. Such sealants can work reliably with the sealant applicator nozzle 10, in part, because such sealants have sufficient fluidity and a temporarily reduced glass-transition temperature (due to the presence of polymer-dissolving solvents or initially un-crosslinked reactive polymers), even when cold, to wet out and establish good adhesion with a variety of surfaces, such as plywood and PVC.

Embodiments of the sealant applicator nozzle 10 can be affixed to a pressurized canister of sealant so that a perfectly shaped and automatically tooled bead 24 of sealant can be conveniently applied to lap joints without the use of a caulking gun. Using the sealant applicator nozzle 10 with a pressure-can aerosol also eliminates the risk of wind-blown over-spray onto unintended surfaces below a roof, such as windows and automobiles. Additionally, when dispensed from a high-pressure pressurized canister, sealants, such as Sashco's Through-The-Roof, can be applied at high speeds, saving a great deal of time, labor, and money.

The sealant applicator nozzle 10, of the present technology, can be used to particularly great effect with clear sealants, such as Sashco's Through-The-Roof or Lexel sealants, because such clear sealants readily permit the applicator to see the lap joint 26 through the sealant and keep the center of the sealant nozzle 10 positioned directly over the edge of the lap joint 26 during application so that the thickest part of the bead 24 is consistently deposited directly over the center of said lap joint 26.

Although the technology been described in language that is specific to certain structures, materials, and methodological steps, it is to be understood that the invention defined in the appended claims is not necessarily limited to the specific structures, materials, and/or steps described. Rather, the specific aspects and steps are described as forms of implementing the claimed invention. Since many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A sealant applicator nozzle, comprising:

an inlet end portion, having a first width, and an opposite outlet end portion, having a second width that is wider than the first width; the inlet end portion and outlet end portion being fluidly coupled with one another by a nozzle interior that extends along a length of the sealant applicator nozzle;

the outlet end portion having: an upper concave tooling edge and an opposing lower edge extending across the second width; opposite side edges extending between the concave tooling edge and lower edge; a concave contact surface bounded by the concave tooling edge, lower edge, and opposite side edges, and extending across the second width; and an outlet orifice that penetrates the contact surface; portions of the contact surface between each side edge and the outlet orifice are thicker than portions of the contact surface between the concave tooling edge and the outlet orifice and between the lower edge and the contact surface to limit lateral dispersion of sealant from the outlet end portion and define side edges of a sealant bead when the sealant applicator nozzle is used;

the concave tooling edge, lower edge, opposite side edges, and contact surface defining a constrained volumetric outlet region when the outlet end portion is positioned against a substrate to which sealant is to be applied.

2. The sealant applicator nozzle of claim 1 wherein the contact surface is disposed at a contact surface angle with respect to a longitudinal plane that passes through the first width and the second width.

3. The sealant applicator nozzle of claim 2 wherein the contact surface angle is between 30 degrees to 60 degrees.

4. The sealant applicator nozzle of claim 2 wherein the contact surface angle is between 40 degrees to 50 degrees.

5. The sealant applicator nozzle of claim 2 wherein the contact surface angle is approximately 45 degrees.

6. The sealant applicator nozzle of claim 1 wherein the inlet end portion includes one or more mechanical fastener structures configured to removably engage an outlet end portion of a sealant container.

7. The sealant applicator nozzle of claim 1 wherein the outlet end portion has an elliptical cross-sectional shape.

8. The sealant applicator nozzle of claim 1 wherein the outlet end portion has a biconvex cross-sectional shape.

9. The sealant applicator nozzle of claim 1 wherein the outlet end portion has a plano-convex cross-sectional shape.

10. A method of applying a sealant to a surface, the method comprising:

positioning a concave contact surface of a sealant applicator nozzle, which surrounds an outlet orifice, closely adjacent the surface; the sealant applicator nozzle having an inlet end portion and an opposite outlet end portion that are fluidly coupled with one another by a nozzle interior that extends along a length of the sealant applicator nozzle; the inlet end portion having a first width; the outlet end portion having a second width that is wider than the first width; the outlet end portion further having: an upper concave tooling edge and an opposing lower edge extending across the second width; opposite side edges extending between the concave tooling edge and lower edge; a concave contact surface bounded by the concave tooling edge, lower edge, and opposite side edges, and extending across the second width; the outlet orifice penetrating the contact surface; portions of the contact surface between each side edge and the outlet orifice are thicker than portions of the contact surface between the concave tooling edge and the outlet orifice and between the lower edge and the contact surface to limit lateral dispersion of sealant from the outlet end portion and define side edges of a sealant bead when sealant is dispensed from the sealant applicator;

the concave tooling edge, lower edge, opposite side edges, and contact surface defining a constrained volumetric outlet region;

positioning the outlet end portion against a surface to which sealant is to be applied; and dispensing a sealant from the outlet orifice in the concave contact surface onto the surface.

11. The method of claim 10 wherein the concave contact surface is disposed at an angle with respect to a longitudinal plane that passes through the first width and the second width.

12. The method of claim 11 wherein the contact surface angle is between 30 degrees to 60 degrees.

13. The method of claim 10 wherein dispensing the sealant includes shaping the sealant into a ribbon bead, having an arched geometry that tapers at opposite edges of the ribbon bead; wherein the shaping is induced by a tooling edge of the contact surface as the sealant is dispensed from the sealant applicator nozzle.

14. The method of claim 13 wherein the arched geometry is defined by an elliptical cross-sectional shape of the outlet end portion.

15. The method of claim 13 wherein the arched geometry is defined by a biconvex cross-sectional shape of the outlet end portion.

16. The method of claim 13 wherein the arched geometry is defined by a plano-convex cross-sectional shape of the outlet end portion.

17. The method of claim 13 wherein the surface is a lap joint and the arched geometry is centered on the lap joint.

18. The method of claim 10 wherein the sealant is dispensed by manually applying pressure to a sealant container.

19. The method of claim 10 wherein the sealant is dispensed from a pressurized sealant container.

* * * * *